US009744579B2

(12) United States Patent
Johnson et al.

(10) Patent No.: US 9,744,579 B2
(45) Date of Patent: Aug. 29, 2017

(54) ROTARY BENDING DEVICES

(71) Applicant: Dayton Lamina Corporation, Dayton, OH (US)

(72) Inventors: Lawrence W. Johnson, Taylor, MI (US); Kevin J. Latouf, Windsor (CA); Nickolas E. Downey, South Boardman, MI (US); Gezim Miftari, Flatrock, MI (US); Thomas William Dollar, Elk Rapids, MI (US)

(73) Assignee: Dayton Lamina Corporation, Dayton, OH (US)

( * ) Notice: Subject to any disclaimer, the term of this patent is extended or adjusted under 35 U.S.C. 154(b) by 0 days.

(21) Appl. No.: 15/287,161

(22) Filed: Oct. 6, 2016

(65) Prior Publication Data

US 2017/0106425 A1 Apr. 20, 2017

Related U.S. Application Data

(60) Provisional application No. 62/243,847, filed on Oct. 20, 2015.

(51) Int. Cl.
*B21D 5/01* (2006.01)
*B21D 5/04* (2006.01)
(Continued)

(52) U.S. Cl.
CPC ..... *B21D 5/042* (2013.01); *B21D 5/02* (2013.01); *B21D 5/0209* (2013.01); *B21D 19/00* (2013.01);
(Continued)

(58) Field of Classification Search
CPC ..... B21D 5/042; B21D 5/02; B21D 39/021; B21D 5/0209; B21D 35/00
(Continued)

(56) References Cited

U.S. PATENT DOCUMENTS 4,002,049 A * 1/1977 Randolph, Sr. ..... B21D 35/00 72/313
4,181,002 A * 1/1980 Eckold ..... B21D 5/042 72/387
(Continued)

FOREIGN PATENT DOCUMENTS

DE 4203680 C1 5/1993
DE 42036801 C1 5/1993
(Continued)

OTHER PUBLICATIONS

European Patent Office, EP Application No. 16194639.7-1702, Extended Search Report dated Mar. 13, 2017 (8 pages).

*Primary Examiner* — David B Jones
(74) *Attorney, Agent, or Firm* — Wood Herron & Evans LLP

(57) ABSTRACT

A rotary bending device for bending workpiece includes a saddle, a rocker, and first and second alignment elements. The saddle includes a longitudinally extending cavity in which the rocker is received, and the rocker rotates relative to the saddle between a neutral position and a bending position for bending the workpiece. The first alignment element is provided on the rocker, and the second alignment element is positioned to engage the first alignment element to limit axial movement of the rocker relative to the saddle during rotation of the rocker between the neutral position and the bending position. The rocker may tangentially contact a bearing surface of the cavity at no more than two lines of tangential contact during rotation. The rocker may further include a longitudinally extending shoulder, and the device may further include a return element positioned to contact the shoulder for biasing the rocker toward the neutral position.

20 Claims, 8 Drawing Sheets

(51) Int. Cl.

| | |
|---|---|
| ***B21D 5/02*** | (2006.01) |
| ***B21D 35/00*** | (2006.01) |
| ***B21D 39/02*** | (2006.01) |
| ***B21D 19/00*** | (2006.01) |
| ***B21D 19/08*** | (2006.01) |

(52) U.S. Cl.
CPC ..... *B21D 19/086* (2013.01); *B21D 35/00* (2013.01); *B21D 39/021* (2013.01)

(58) Field of Classification Search
USPC ..... 72/387
See application file for complete search history.

(56) References Cited

U.S. PATENT DOCUMENTS 4,434,644 A * 3/1984 Gargrave ..... B21D 5/0209 72/387
4,562,721 A * 1/1986 Bleyer ..... B21D 39/02 72/210
5,341,669 A * 8/1994 Katz ..... B21D 5/042 72/313
5,361,620 A * 11/1994 Meadows ..... B21D 5/02 72/313
5,404,742 A * 4/1995 Wilson ..... B21D 39/021 72/319
5,913,931 A 6/1999 Gargrave et al.
6,983,634 B2 * 1/2006 Chun ..... B21D 5/02 72/313
7,141,534 B2 11/2006 Danly, Sr. et al.
8,322,181 B2 * 12/2012 Wilson ..... B21D 5/042 72/319
2011/0265546 A1 11/2011 Wilson

FOREIGN PATENT DOCUMENTS

EP 0555752 A1 8/1993
FR 2365383 A1 4/1978

* cited by examiner

ROTARY BENDING DEVICES

CROSS-REFERENCE TO RELATED APPLICATION

This application claims the filing benefit of U.S. Provisional Application Ser. No. 62/243,847, filed Oct. 20, 2015, the disclosure of which is hereby incorporated by reference herein in its entirety.

TECHNICAL FIELD

The present invention relates generally to devices for forming materials, and more particularly, to devices for bending malleable materials.

BACKGROUND

Rotary bending devices, also known as rotary benders, are commonly used for forming simple and modified bends in malleable sheet materials, such as sheet metal. Rotary benders generally include a saddle having a cylindrically shaped cavity and a generally cylindrically shaped rocker received within the cavity and being rotatable within the cavity relative to the saddle. In use, rotary benders are generally mounted to a press. During a downstroke of the press, the rocker is forced into contact with the workpiece and rotates within the saddle cavity to bend a portion of the workpiece about an anvil on which the workpiece is supported.

It is generally desirable to stabilize the rocker relative to the saddle while simultaneously minimizing friction generated between the rocker and the saddle during rotation. It is also desirable to limit the range through which the rocker rotates relative to the saddle when returning to a neutral position from a bending position. However, known rotary benders are deficient in these respects and others. Accordingly, there is a need for improvements to known rotary benders.

SUMMARY

A rotary bending device for bending a workpiece according to an exemplary embodiment of the invention includes a saddle, a rocker, and first and second alignment elements. The saddle includes a longitudinally extending cavity in which the rocker is received, and the rocker rotates relative to the saddle between a neutral position and a bending position for bending the workpiece. The first alignment element is provided on the rocker, and the second alignment element is positioned to engage the first alignment element to limit axial movement of the rocker relative to the saddle during rotation of the rocker between the neutral position and the bending position.

A rotary bending device for bending a workpiece according to another exemplary embodiment of the invention includes a saddle having a longitudinally extending cavity provided with a bearing surface, and a rocker received within the cavity. The rocker rotates relative to the saddle between a neutral position and a bending position for bending the workpiece. The rocker tangentially contacts the bearing surface of the saddle at no more than two lines of tangential contact during rotation of the rocker between the neutral position and the bending position.

A rotary bending device for bending a workpiece according to another exemplary embodiment of the invention includes a saddle, a rocker, and at least one return element. The saddle includes a longitudinally extending cavity in which the rocker is received. The rocker has a longitudinally extending shoulder and rotates relative to the saddle between a neutral position and a bending position for bending the workpiece. The at least one return element is positioned to contact the longitudinally extending shoulder of the rocker for biasing the rocker toward the neutral position.

Various additional features and advantages of the invention will become more apparent to those of ordinary skill in the art upon review of the following detailed description of exemplary embodiments taken in conjunction with the accompanying drawings. The drawings, which are incorporated in and constitute a part of this specification, illustrate one or more exemplary embodiments of the invention and, together with the general description given above and the detailed description given below, serve to explain the exemplary embodiments.

DETAILED DESCRIPTION

Figure 1:
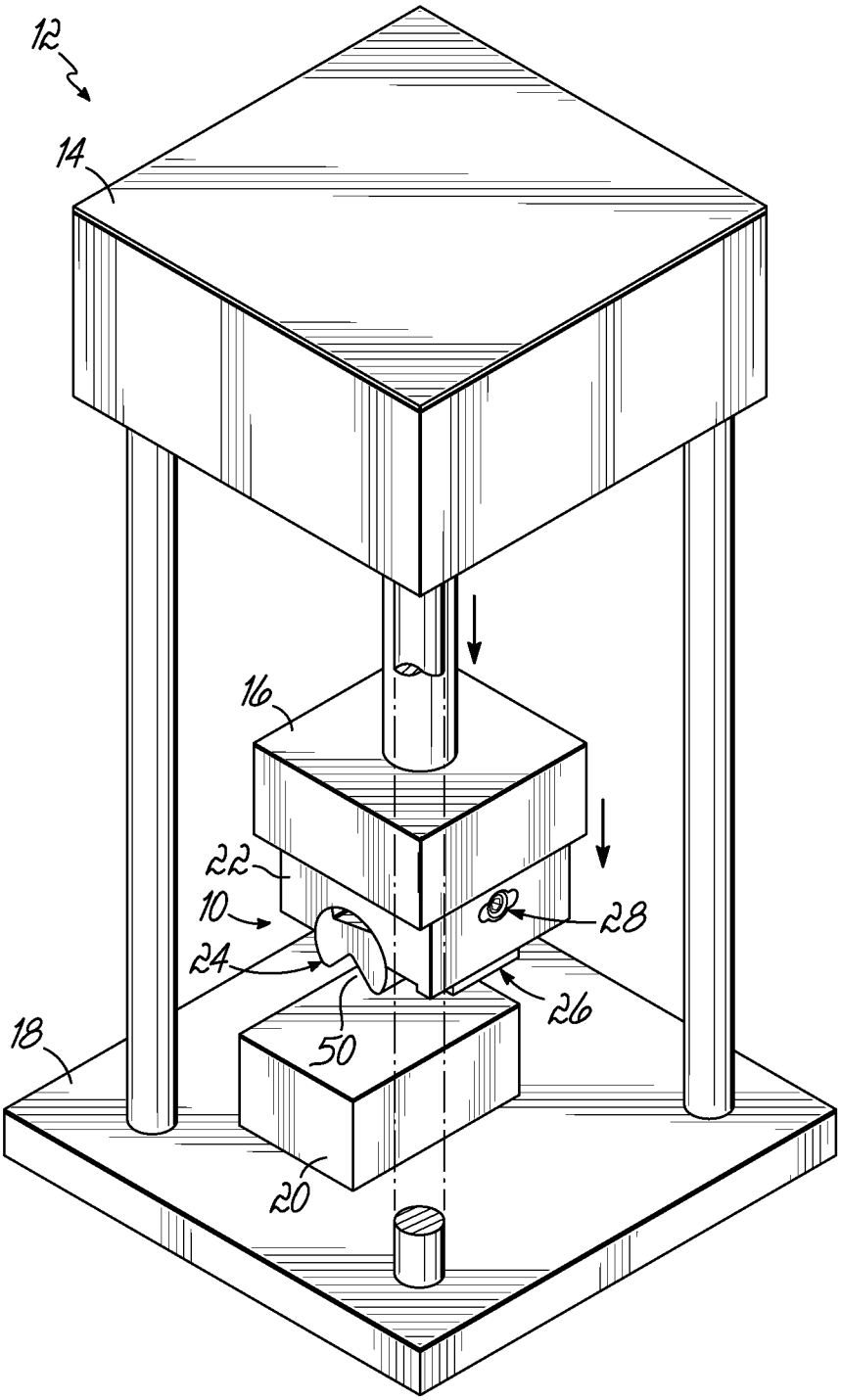
FIG. 1 is a schematic view of a press to which a rotary bender according to an exemplary embodiment of the invention is mounted.

Referring to FIG. 1, a rotary bender 10 according to an exemplary embodiment of the invention is shown mounted on a press 12, shown schematically. The press 12 generally includes a drive 14, a ram 16 coupled to and driven linearly by the drive 14, and a base 18 positioned beneath the ram 16. The rotary bender 10 is mounted to a lower surface of the ram 16 and includes a saddle 22 and a rocker 24, as will be described in greater detail below. A lower tool piece, shown in the form of an anvil 20, is coupled to an upper surface of the base 18 and supports a workpiece (e.g., workpiece 92 shown in FIGS. 6A-6C), such as a piece of sheet metal or other malleable sheet material. While the press 12 is shown oriented such that the ram 16 and rotary bender 10 move vertically, it will be appreciated that the press 12 may be positioned in various alternative orientations as desired.

The press 12 may be controlled to drive the ram 16 downwardly toward the base 18 to force the rotary bender 10 into contact with the workpiece, thereby forming the workpiece against the anvil 20. The ram 16 is then raised from the anvil 20 so the formed workpiece may be released, and a fresh workpiece may be positioned on the anvil 20. A variety of bend types may be formed in the workpiece using the rotary bender 10, such as 90 degree bends, square bends, over square bends, under square bends, channel bends, hat bends, zee bends, short leg bends, and "J" bends, for example. The structural features and operation of the rotary bender 10 are described in greater detail below.

Figure 2:
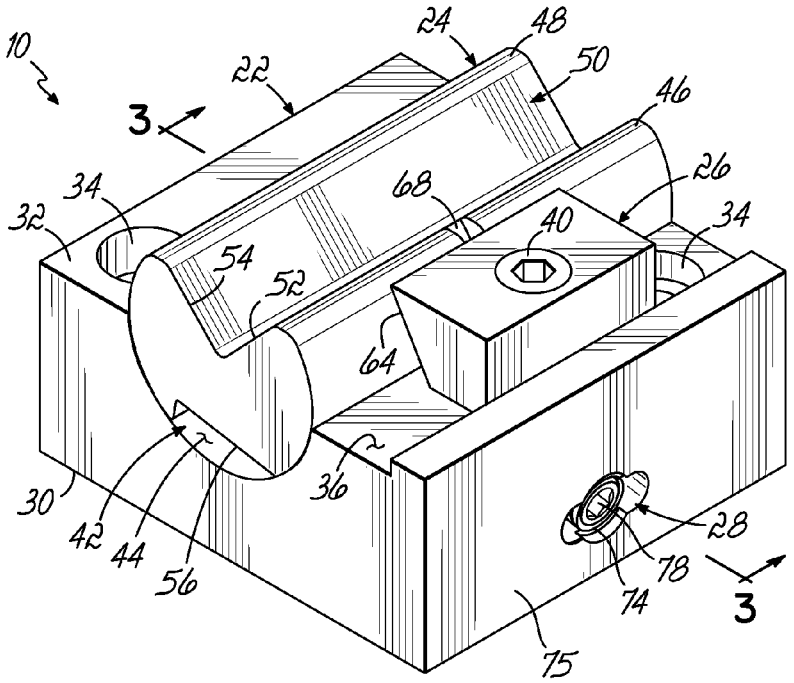
FIG. 2 is a perspective view of a rotary bender according to an exemplary embodiment of the invention.
Figure 3:
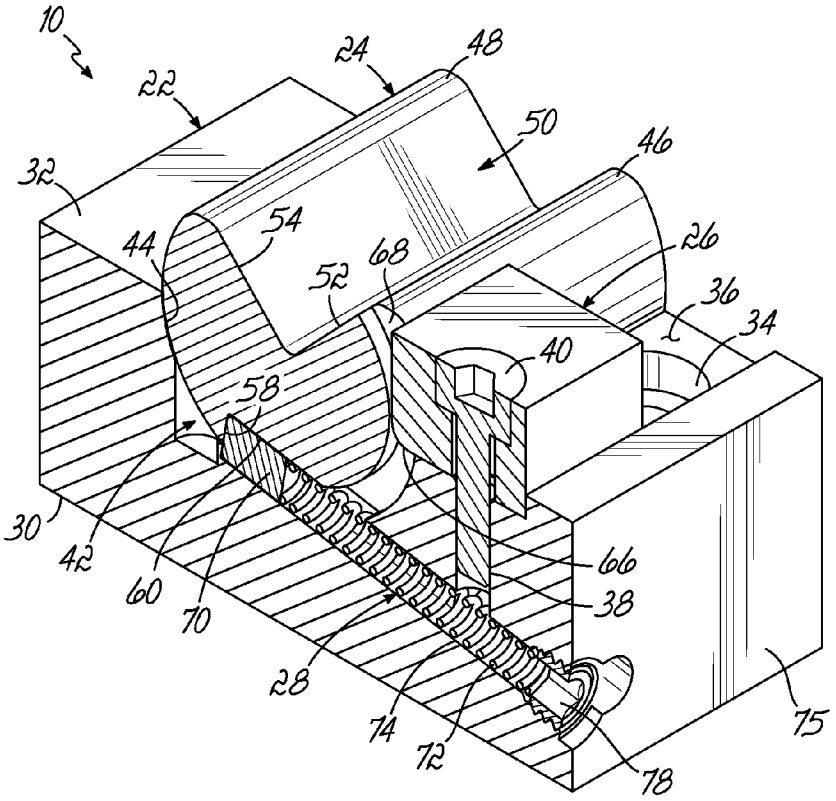
FIG. 3 is a cross-sectional view taken along line 3-3 of the rotary bender of FIG. 2.
Figure 4:
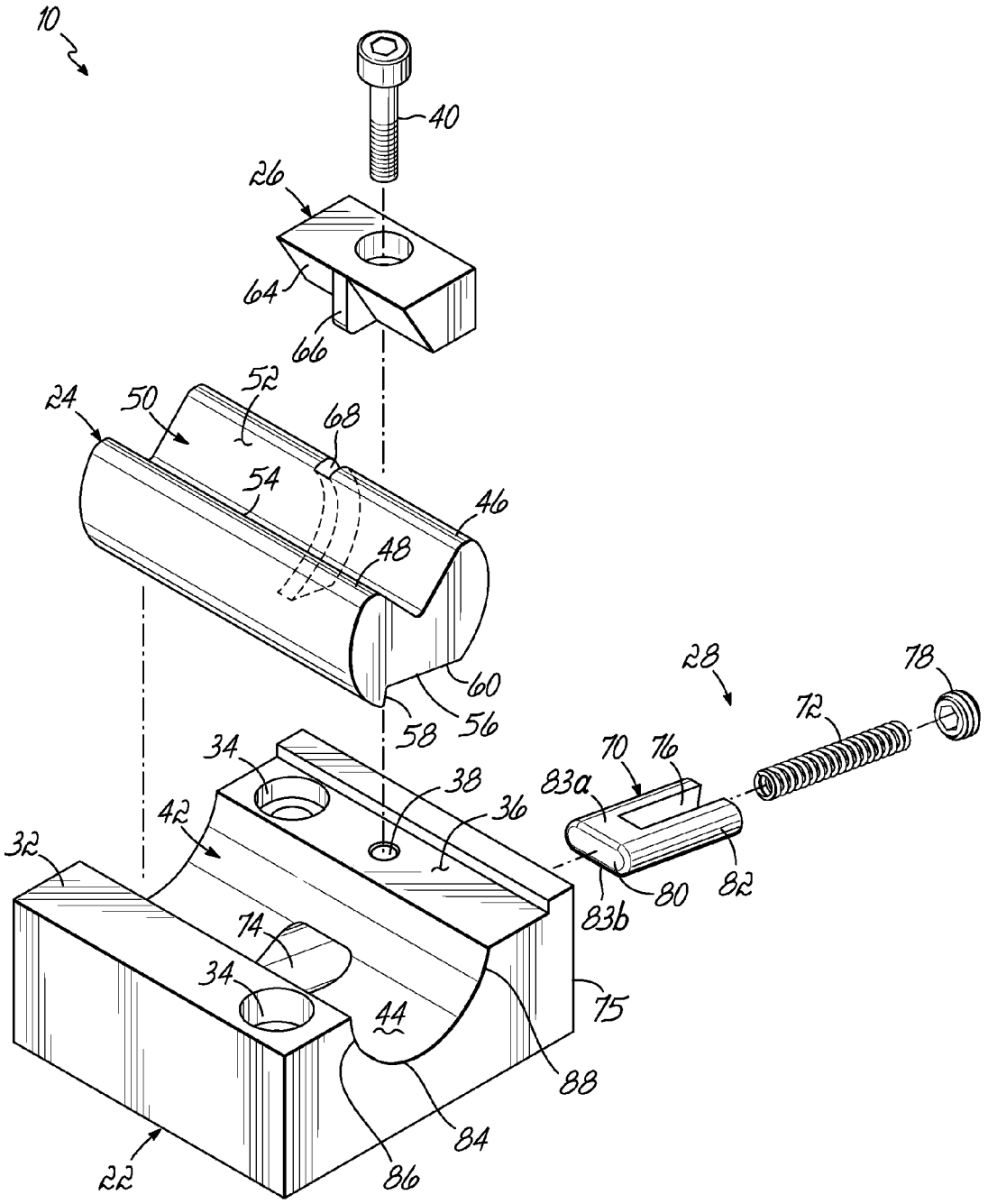
FIG. 4 is a disassembled, perspective view of the rotary bender of FIG. 2.

Referring to FIGS. 2-4, the exemplary rotary bender 10 generally includes a saddle 22, a rocker 24 operatively coupled to the saddle 22 and rotatable about a longitudinal axis, a gib 26 coupled to the saddle 22 and positioned to contact the rocker 24 for coupling the rocker 24 to the saddle 22, and a return element 28 for biasing the rocker 24 toward a neutral rotational position. As described below, the rocker 24 is rotatable within the saddle 22 between a neutral position as shown in FIG. 6A, and a bending position for bending a workpiece as shown in FIG. 6B.

Figure 6A:
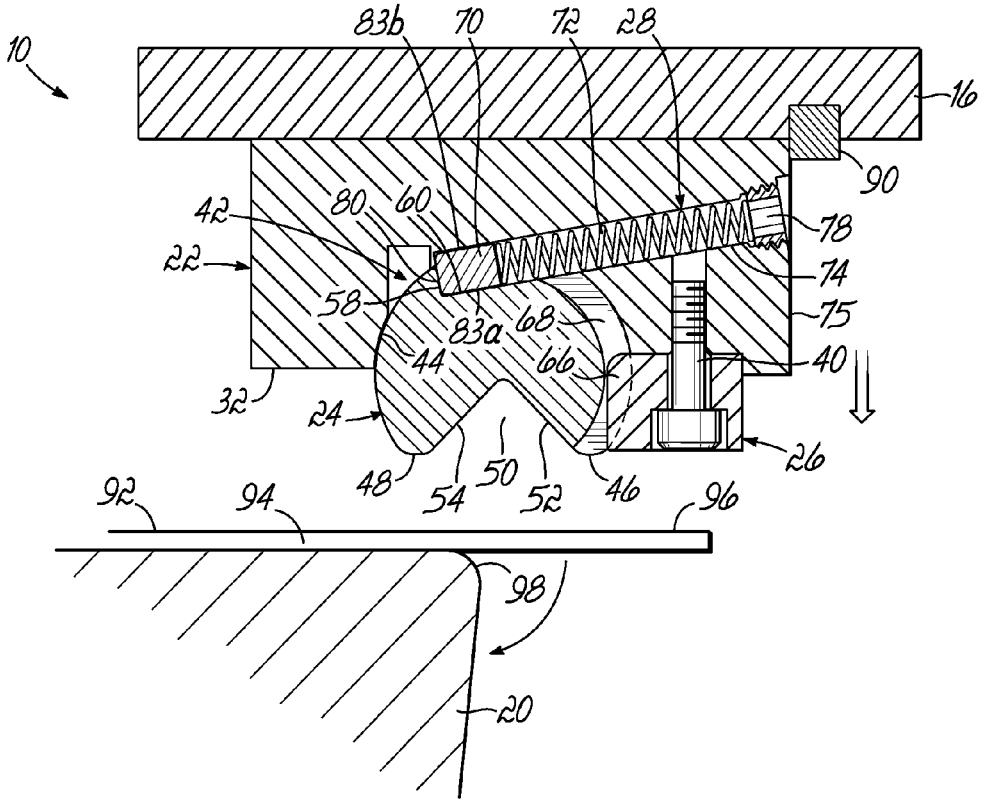
FIG. 6A is a side cross-sectional view of the rotary bender of FIG. 2, showing the rocker in a neutral position prior to being forced into contact with a workpiece.
Figure 6B:
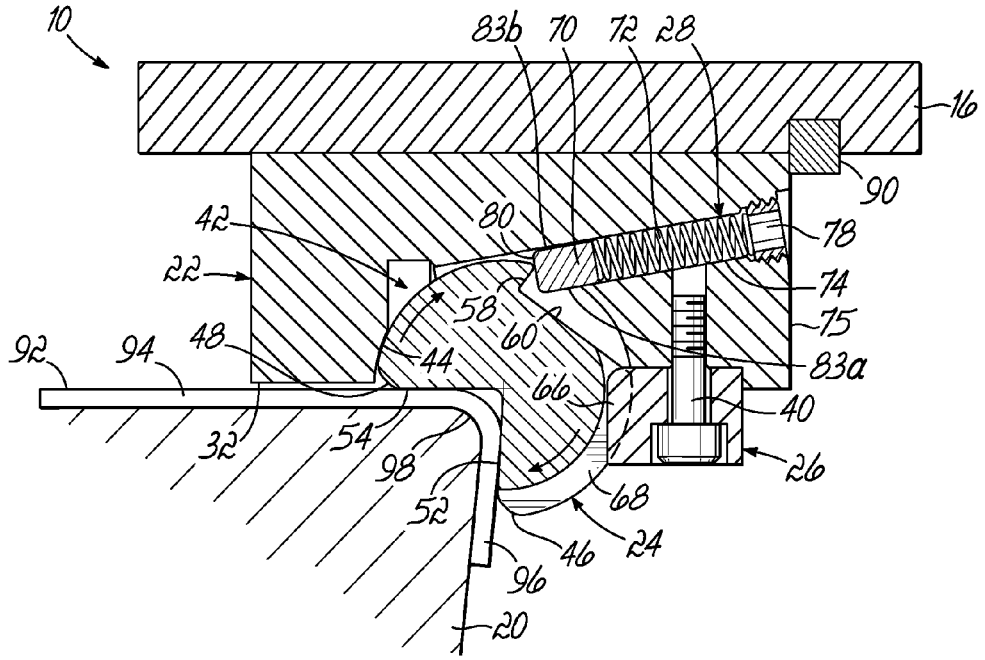
FIG. 6B is a view similar to FIG. 6A, showing the rocker being forced into contact with the workpiece and rotated into a bending position for bending the workpiece about an anvil.
Figure 6C:
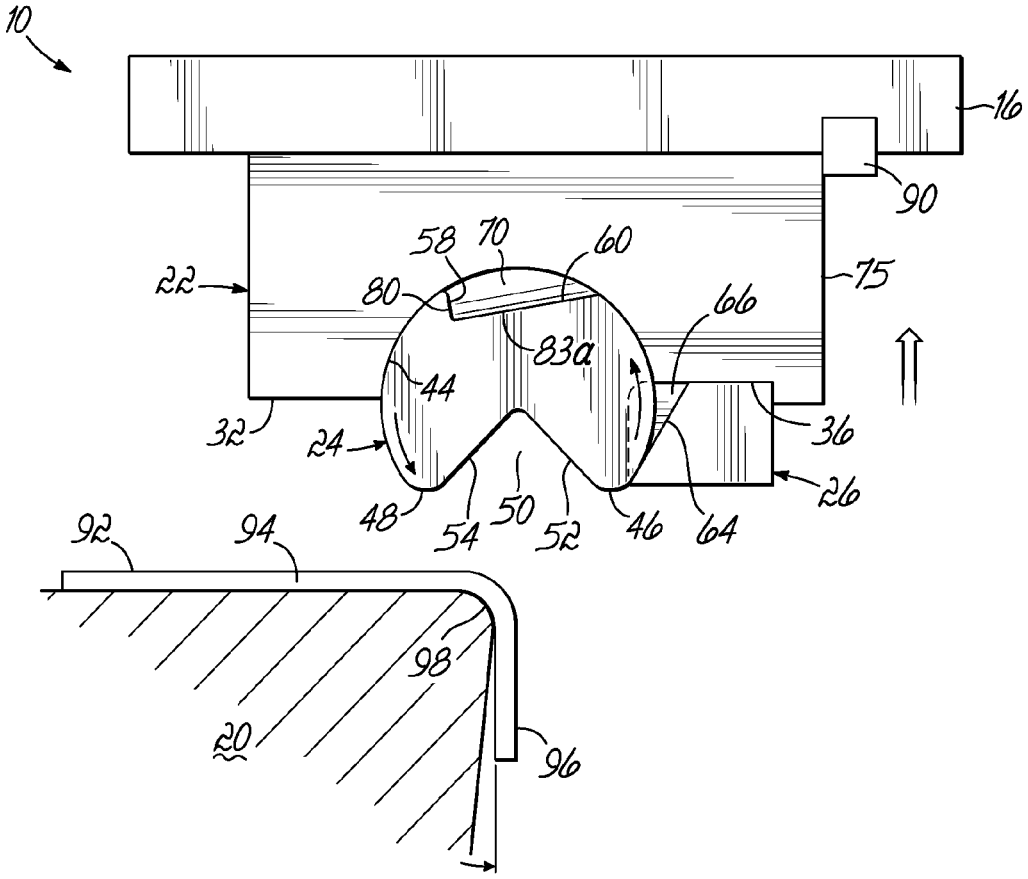
FIG. 6C is a view similar to FIGS. 6A and 6B, showing the rotary bender displaced from the bent workpiece after the bending operation, and the rocker returned to the neutral position.

The saddle 22 functions as a base block of the rotary bender 10, and includes a base side 30 that faces the ram 16 of the press 12 and an oppositely disposed forming side 32 that faces the workpiece when mounted for operation, as shown in FIGS. 6A-6C. The forming side 32 may include one or more through bores 34 that receive respective fasteners (not shown) for securing the rotary bender 10 to the ram 16. The forming side 32 further includes a gib landing surface 36 that supports the gib 26, and which may include a threaded bore 38 for receiving a threaded fastener 40 for coupling the gib to the saddle 22.

A saddle cavity 42 extends longitudinally through the saddle 22, for example spanning a full width of the saddle 22, and opens to the forming side 32. The saddle cavity 42 receives the rocker 24 and includes a bearing surface 44 that engages an outer surface of the rocker 24. The bearing surface 44 may be provided with a lubricous layer for facilitating rotation of the rocker 24 within the saddle cavity 42 and minimizing friction between rocker 24 and saddle 22. In one embodiment, the lubricous layer may be in the form of a dry film lubricant, such as molybdenum disulfide. The dry film lubricant may be applied to the bearing surface 44 by spraying, for example. In another exemplary embodiment, the lubricous layer may be defined by a plurality of self-lubricating plugs and the bearing surface 44 may be provided with a bronze alloy layer, as described in greater detail below in connection with FIG. 7. It will be appreciated that various alternative suitable lubricous materials and configurations may be used for lubricating the rocker 24 and saddle 22 interface.

The rocker 24 extends longitudinally and defines a longitudinal axis about which the rocker 24 rotates relative to the saddle 22 within the saddle cavity 42. The rocker 24 includes first and second bending lobes 46 and 48 that protrude radially and angularly outward from the longitudinal axis of the rocker 24, and a forming channel 50 that extends longitudinally between the bending lobes 46, 48. As described below, the bending lobes 46, 48 engage a workpiece and bend a skirt portion of the workpiece about an anvil 20 when the rotary bender 10 is forced into contact with the workpiece.

The first and second bending lobes 46, 48 include respective first and second forming faces 52 and 54 that define respective first and second sides of the forming channel 50. While the forming faces 52, 54 are shown herein as being contiguously planar along the length of the rocker 24, one or both of the forming faces 52, 54 may be provided with one or more forming features, such as a protrusion (not shown), for forming similarly shaped features in the bent workpiece as desired. It will be appreciated that each of the bending lobes 46, 48 may be formed with any suitable surface area, and that the forming channel 50 may define any suitable angle between the forming faces 52, 54, such as 87 degrees for example, for providing a desired bend degree in the workpiece.

The rocker 24 further includes a shoulder 56 that extends longitudinally along a full length of the rocker 24. In the illustrated embodiment, the shoulder 56 is defined by a longitudinally extending rectangular notch formed in the rocker 24, and is substantially diametrically opposed from the bending lobes 46, 48 and the forming channel 50. As best shown in FIGS. 3 and 4, the shoulder 56 includes a first shoulder surface 58 and a second shoulder surface 60 extending substantially perpendicularly to the first shoulder surface 58. Each of the shoulder surfaces 58, 60 extends contiguously along a full length of the rocker 24, and may be planar.

As described below, the first shoulder surface 58 contacts a first portion of the return element 28 for biasing the rocker 24 toward the neutral position. The second shoulder surface 60 contacts a second portion of the return element 28 for preventing rotation of the rocker 24 beyond the neutral position when rotating from the bending position. Advantageously, the contiguous configuration of the shoulder surfaces 58, 60 allows for the rocker 24 to be cut to any suitable length for a desired application, while maintaining the functionality of the shoulder 56 and its shoulder surfaces 58, 60 for effectively engaging the return element 28. In other words, the shoulder 56 is formed such that the return element 28 may effectively engage the shoulder 56 at any position along the length of the rocker 24.

The gib 26 is coupled to the saddle 22 at the gib landing surface 36, for example by a threaded fastener 40, and is positioned to contact the rocker 24 for retaining the rocker 24 within the saddle cavity 42. As best shown in FIG. 4, the gib 26 includes an angled contact face 64 that tangentially contacts an outer surface of the rocker 24 extending between the first bending lobe 46 and the second shoulder surface 60. While only one gib 26 is shown, it will be appreciated that any suitable quantity of gibs 26 may be provided for coupling the rocker 24 to the saddle 22 depending on the length of the rocker 24 and the saddle 22, each gib 26 securing a respective longitudinal portion of the rocker 24 to a respective longitudinal portion of the saddle 22.

As best shown in FIGS. 3 and 4, the rotary bender 10 includes a plurality of axial alignment elements for limiting axial movement of the rocker 24 relative to the saddle 22 during rotation of the rocker 24 within the saddle cavity 42. In the illustrated embodiment, a first alignment element in the form of a rib 66 projects outwardly from the angled contact face 64 of the gib 26, and a second alignment element in the form of a circumferential slot 68 is provided on the rocker 24. As shown in FIG. 3, the circumferential slot 68 extends circumferentially about the longitudinal axis of the rocker 24 between the first bending lobe 46 and the second shoulder surface 60. The rib 66 may be formed with a substantially triangular shape and projects radially inward into the circumferential slot 68. The circumferential slot 68 may be formed with an axial width sufficient to accommodate an axial thickness of the rib 66 with at least a slip fit interface, such that the rocker 24 may rotate freely relative to the gib 26 with minimal generation of friction. The circumferential slot 68 may also be formed with a radial depth sufficient to accommodate a maximum dimension of the rib 66 in a direction outwardly from the contact face 64.

In an alternative embodiment in which the rotary bender 10 includes multiple gibs 26 for securing the rocker 24 within the saddle cavity 42, the rocker 24 may be provided with one or more circumferential slots 68 that receive the ribs 66 of respective gibs 26. Additionally, while the illustrated embodiment includes a rib 66 provided on the gib 26 and a circumferential slot 68 provided in the rocker 24, a reverse configuration may alternatively or additionally be employed. Moreover, various alternative axial alignment elements other than ribs and circumferential slots may be suitably used.

Still referring to FIGS. 3 and 4, the return element 28 generally includes a plunger 70 and a biasing element shown in the form of a compression return spring 72. The plunger 70 is received within a plunger passageway 74 formed in the saddle 22. The passageway 74 opens at a first end to a base portion of the saddle cavity 42 along the bearing surface 44, and at a second end to a side surface 75 of the saddle 22. The plunger 70 is slidable within the passageway 74 and is biased by the return spring 72 toward the saddle cavity 42 such that the plunger 70 exerts a substantially constant force on the first shoulder surface 58 of the rocker 24 for biasing the rocker 24 toward the neutral rotational position, shown in FIG. 6A. The plunger 70 may include a centrally formed internal channel 76 sized to receive and axially constrain a portion of the return spring 72. An anchor element, shown in the form of a set screw 78, may be positioned within an outer end of the passageway 74 for retaining the return spring 72 within the passageway 74 and maintaining the bias force exerted by the plunger 70 on rocker shoulder surface 58.

As shown in FIG. 4, the plunger 70 generally includes a tip 80 and a side surface 82. The plunger tip 80 contacts the first shoulder surface 58 of the rocker 24 for biasing the rocker 24 toward the neutral rotational position (FIG. 6A). The plunger side surface 82 is adapted to contact the second shoulder surface 60 of the rocker 24 when in the neutral rotational position. In this manner, the plunger side surface 82 functions as a mechanical stop and prevents rotation of the rocker 24 beyond the neutral position when the rocker 24 rotates from the bending position (FIG. 6B) under the bias force exerted by the plunger tip 80 and return spring 72.

Figure 7:
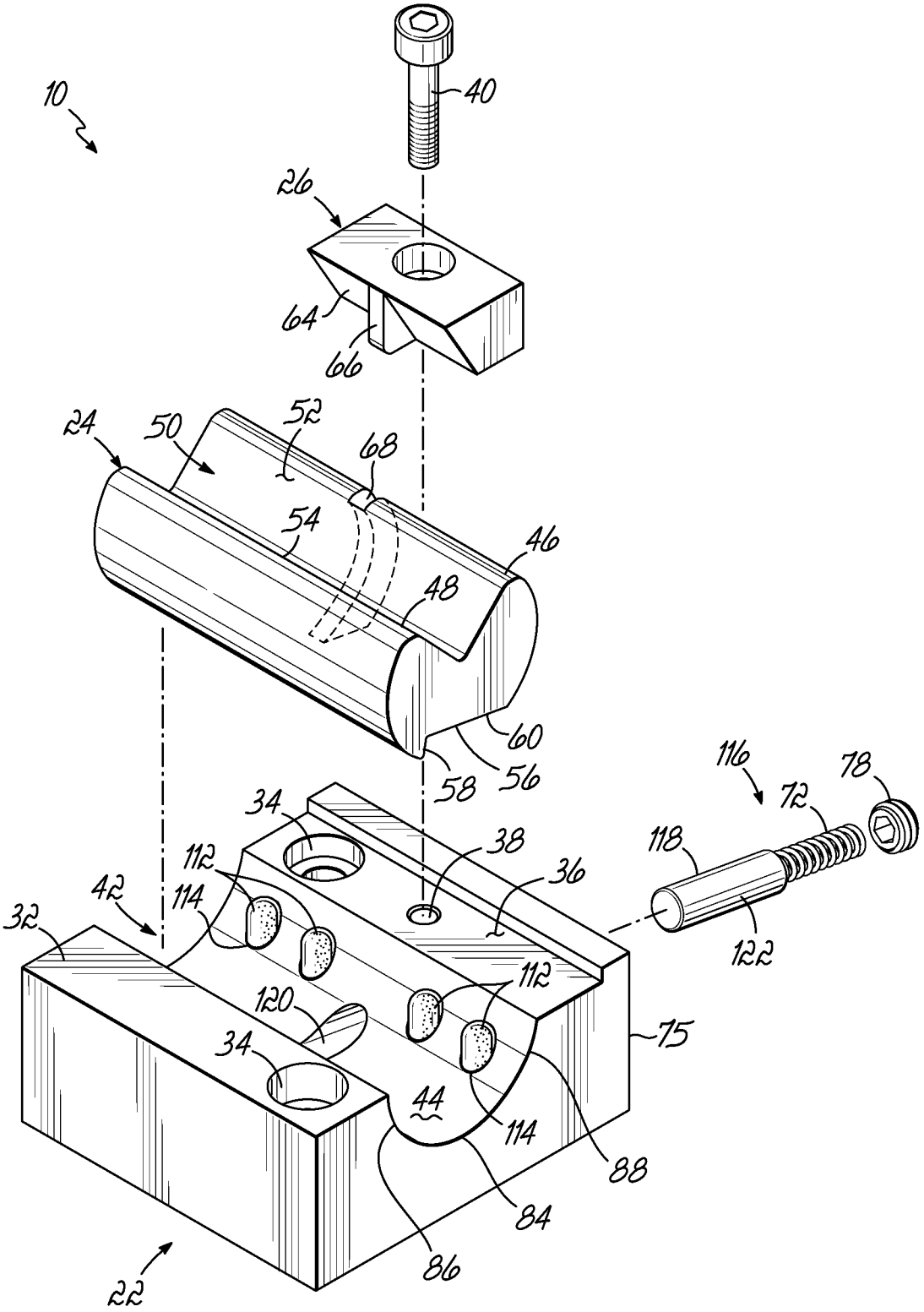
FIG. 7 is a disassembled, perspective view of a rotary bender according to another exemplary embodiment of the invention.

The plunger 70 may be formed with a noncircular cross-section, such as the rounded rectangular cross-section shown in FIG. 4. The rounded rectangular cross-section of the plunger 70 defines a side surface 82 having first and second planar faces 83*a*, 83*b* oppositely disposed from one another. As best shown in FIGS. 6A and 6C, when the rocker is in the neutral position, the first planar face 83*a* of the plunger 70 confronts the second shoulder surface 60 of the rocker 24, while the second planar face 83*b* confronts a planar base surface of the plunger passageway 74. Advantageously, the first planar face 83*a* of the plunger side surface 82 contacts the second shoulder surface 60 of the rocker 24 with a greater area of contact than a plunger having a fully rounded side surface. Accordingly, the planar faces 83*a*, 83*b* of the plunger side surface 82 provide for decreased stresses exerted on the plunger 70, and thus improved anti-rotational support for the rocker 24 in the neutral position. It will be appreciated that the plunger 70 may be formed with various alternative cross-sectional shapes as desired. For example, the alternative embodiment of FIG. 7 shows a plunger 118 having a circular cross-section.

The plunger passageway 74 is sized and shaped to receive the plunger 70. For example, the plunger 70 and plunger passageway 74 may both be formed with noncircular cross-sections, as shown in the embodiment of FIG. 4. Alternatively, the plunger 70 and passageway 74 may be formed with circular cross-sections, as described in greater detail below in connection with FIG. 7. In embodiments in which the plunger 70 is formed with a noncircular cross-section, such as the embodiment of FIG. 4, the passageway 74 may include a centrally formed circular bore portion, best shown in FIGS. 2 and 3, that receives the return spring 72 and the set screw 78. It will be appreciated that the plunger passageway 74 may be formed with various alternatively shaped cross-sections to accommodate a correspondingly shaped cross-section of the plunger 70.

While the rotary bender 10 is shown herein with a single return element 28, any suitable quantity of return elements 28 and corresponding plunger passageways 74 may be provided depending on the length of the rocker 24 and the saddle 22. For example, a return element 28 may be positioned at each location of a gib 26. Advantageously, as described above, the rocker shoulder 56 extends contiguously along a length of the rocker 24 and is adapted to engage one or more return elements 28 at generally any location along the length of the rocker 24. That is, the available positioning of a return element 28 along the length of the saddle cavity 42 is independent of the rocker feature that contacts the return element 28, namely, the rocker shoulder 56.

Figure 5A:
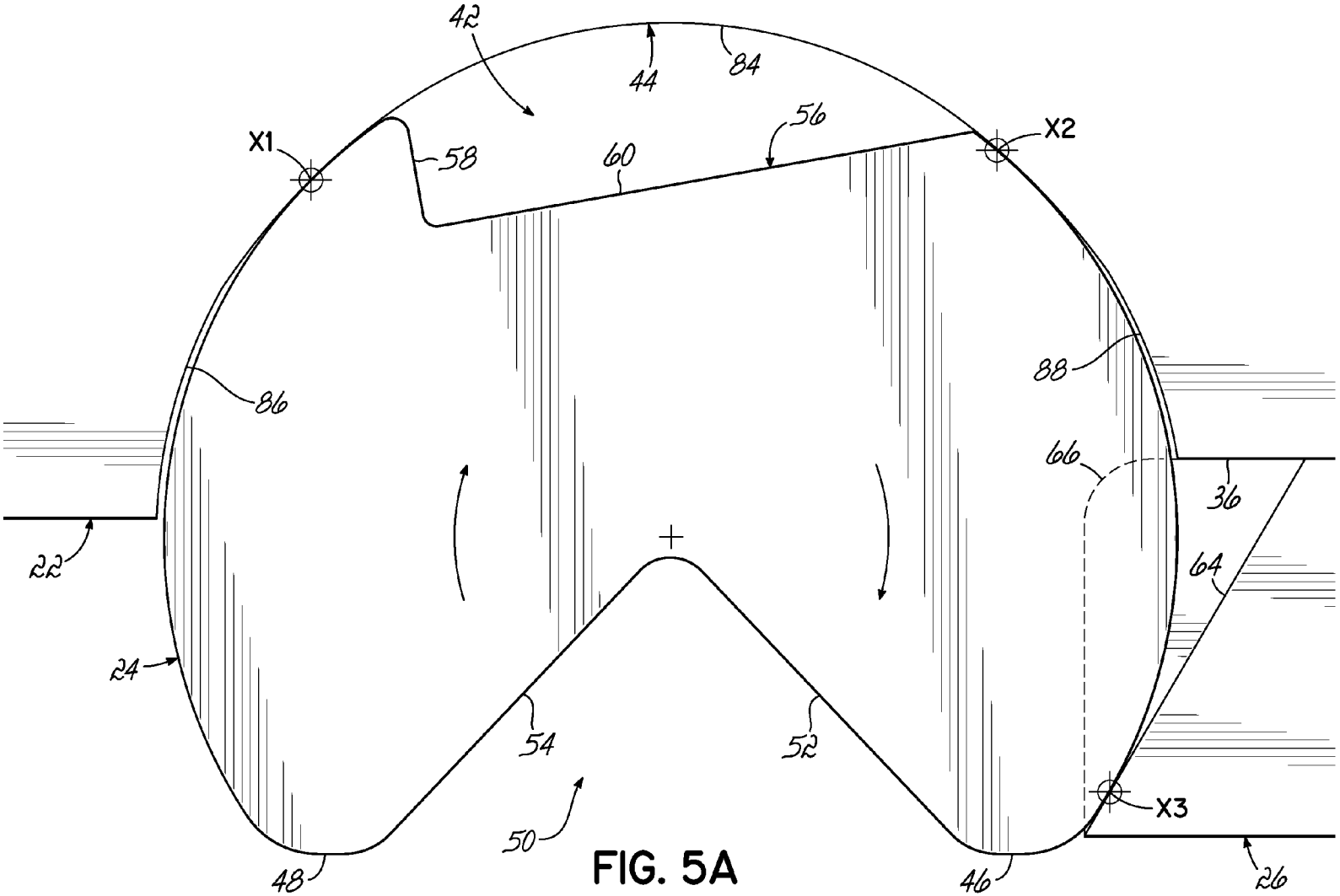
FIG. 5A is an enlarged, side elevation view of a rocker, a saddle, and a gib of the rotary bender of FIG. 2.
Figure 5B:
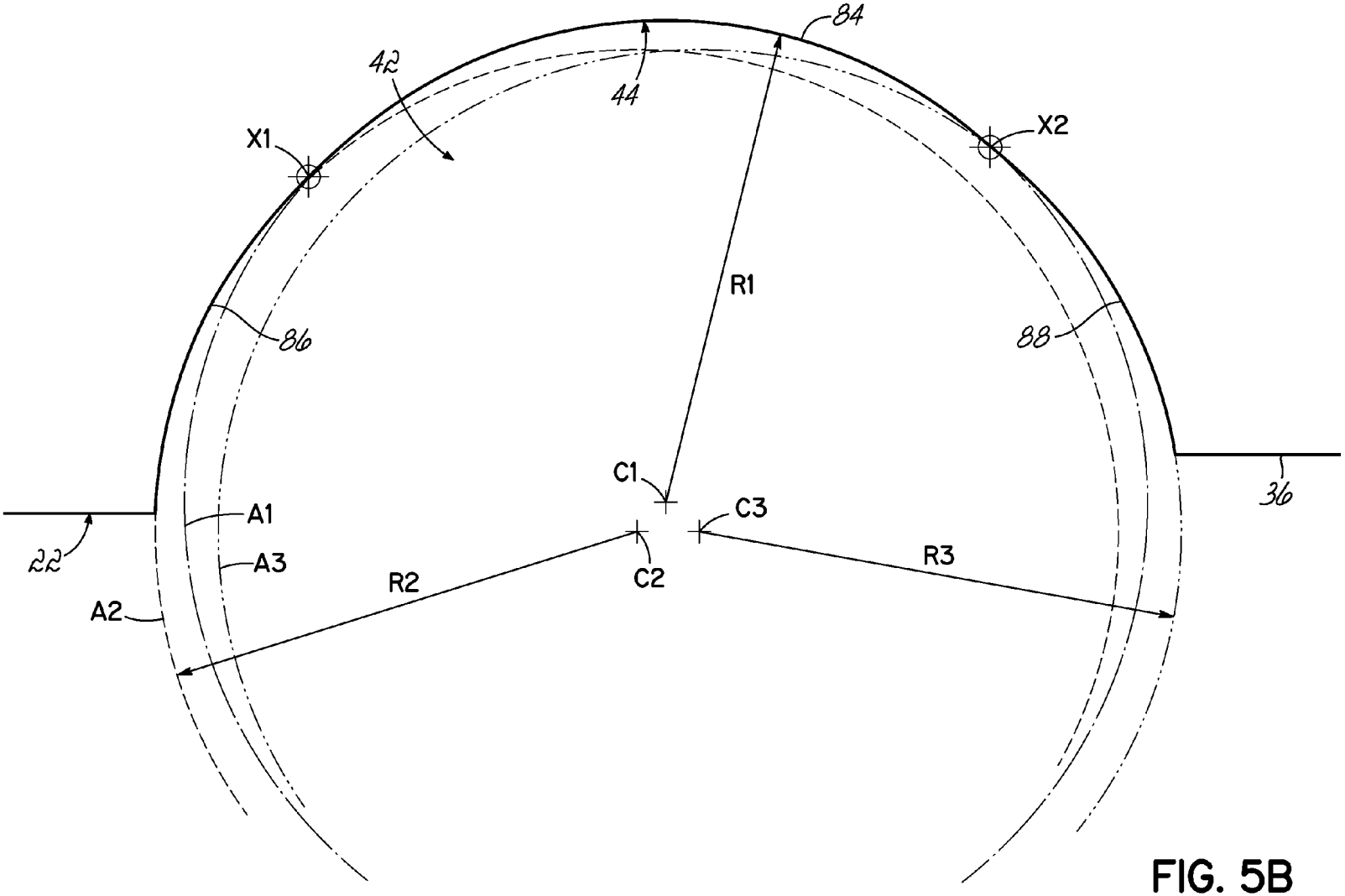
FIG. 5B is an enlarged, side elevation view of the saddle of the rotary bender of FIG. 2, showing geometric details of the cross-sectional shape of a cavity extending longitudinally through the saddle.

Referring to FIGS. 5A and 5B, additional details of the saddle cavity 42 and the interface of the rocker 24 with the saddle 22 and the gib 26 will now be described. The saddle cavity 42 is formed with a noncircular cross-section, as compared to the substantially circular cross-section with which the rocker 24 is formed. Advantageously, this configuration minimizes the contact area, and thus friction generated, between the saddle 22 and the rocker 24.

In an exemplary embodiment, as shown in FIG. 5B, the noncircular cross-sectional shape of the saddle cavity 42 may be defined by first, second, and third overlapping circular arcs A1, A2, and A3. Each of the arcs A1, A2, A3 includes a corresponding center indicated by C1, C2, and C3, respectively, and is defined by a corresponding radius indicated by R1, R2, and R3, respectively. The radii R1, R2, R3 may be equal to one another, for example. As shown in FIG. 5B, the first arc A1 is positioned centrally and defines an innermost base portion 84 of the saddle cavity 42. The second and third arc centers C2, C3 are positioned outwardly from the first arc center C1 in a direction away from the base portion of the saddle cavity 42, and are equidistant from the first arc center C1. The second and third arcs A2, A3 define corresponding side portions 86, 88 of the saddle cavity 42. Accordingly, the bearing surface 44 may be understood to have an innermost base portion 84 defined by the first arc A1, a first side portion 86 defined by the second arc A2, and a second side portion 88 defined by the third arc A3.

The junction of the base portion 84 with the first side portion 86 defines a first line X1, extending along the length of the saddle cavity 42, at which the rocker 24 tangentially contacts the bearing surface 44. Similarly, the junction of the base portion 84 with the second side portion 88 defines a second line X2, extending along the length of the saddle cavity 42, at which the rocker 24 tangentially contacts the bearing surface 44.

As shown best in FIG. 5A, the rocker 24 tangentially contacts the angled contact face 64 of the gib 26 at a third line X3. It will be understood that the contact lines X1, X2, X3 are fixed relative to the saddle 22 and the gib 26. Accordingly, specified circumferential portions of the outer surface of the rocker 24 may rotate into and out of engagement with the contact lines X1, X2, X3 as the rocker 24 rotates between the neutral position (FIG. 6A) and the bending position (FIG. 6B). Moreover, depending on the rotational position of the rocker 24 between the neutral and bending positions, the rocker shoulder 56 may be oriented relative to the bearing surface 44 such that the rocker 24 contacts the bearing surface 44 at only the first contact line X1. In this regard, it will be appreciated that the rocker 24 may tangentially contact the bearing surface 44 at no more than two lines of tangential contact at any given rotational position of the rocker 24 relative to the saddle 22.

Referring to FIGS. 6A-6C, an exemplary bending operation using rotary bender 10 is shown. Similar to FIG. 1, the rotary bender 10 is shown mounted to the underside of a ram 16, using a key 90. A workpiece 92 having a body portion 94 and a skirt portion 96 to be bent is positioned on the anvil 20 such that the skirt portion 96 extends beyond a beak 98 of the anvil 20. Though not shown, the skirt portion 96 may be slightly pre-bent relative to the body portion 94. As noted above, while the ram 16 is shown herein performing vertical movements, it will be appreciated that the press 12 driving the ram 16 may be oriented as desired to achieve various alternative directions of movement in which the ram 16 moves linearly relative to the anvil 20. Accordingly, the terms "upstroke," "downstroke," "upward," "downward," "raise," "lower," and similar terms as used herein are not intended to limit the scope of the invention to a particular orientation of the press 12 and rotary bender 10.

As shown in FIG. 6A, the rotary bender 10 is spaced from the workpiece 92, with the rocker 24 retained in the neutral rotational position by the return element 28. In particular, the tip 80 of the plunger 70 contacts and exerts an outwardly directed force, transferred from the return spring 72, on the first rocker shoulder surface 58 so as to urge the rocker 24 in a counter-clockwise rotational direction, for example. The second rocker shoulder surface 60 contacts the first planar side face 83*a* of the plunger 70, which prevents the rocker 24 from rotating, in the exemplary counter-clockwise direction, beyond the neutral position shown in FIG. 6A.

While the rocker 24 is in its neutral rotational position, the ram 16 initiates a downward stroke in which the rotary bender 10 is moved linearly toward the workpiece 92, thereby forcing the bending lobes 46, 48 of the rocker 24 into contact with the workpiece 92. The second bending lobe 48 clamps the body portion 94 of the workpiece 92 against an upper surface of the anvil 20 and the first bending lobe 46 engages, or at least proximately confronts, the skirt portion 96. As the ram 16 continues to drive the rotary bender 10 toward the anvil 20, the rocker 24 rotates within the saddle cavity 42 so that the first bending lobe 46 bends the skirt portion 96 around the anvil beak 98 and toward a side surface of the anvil 20, as shown in FIG. 6B. Simultaneously, the first rocker shoulder surface 58 forces the plunger 70 into the plunger passageway 74, thereby compressing the plunger spring 72. This compression of the spring 72 causes the plunger tip 80 to continuously engage and exert an outwardly directed force on the rocker shoulder surface 58.

As shown in FIG. 6B, the rocker 24 has rotated fully into its bending rotational position, in which the first forming face 52 of the rocker 24 clamps the skirt portion 96 against the side surface of the anvil 20, and the second forming face 54 clamps the body portion 94 against upper surface of the anvil 20, thereby bending the skirt portion 96 relative to the body portion 94. As shown, the bent portion of the workpiece 92 is received within the rocker forming channel 50. The forming channel 50 and the anvil beak 98 may be formed with similar angles so as to provide the skirt portion 96 with any desired degree of overbend, such as up to three degrees, for example.

As shown in FIG. 6C, once the skirt portion 96 of the workpiece 92 has been fully bent, the ram 16 initiates an upstroke to raise the rotary bender 10 away from the bent workpiece 92. As the ram 16 rises, the rocker 24 is allowed to rotate back toward its neutral rotational position. More specifically, as the rocker 24 rises with the ram 16 away from the bent workpiece 92, the force exerted on the plunger 70 by the compressed return spring 72 is transferred by the plunger tip 80 to the first rocker shoulder surface 58, thereby urging the rocker 24 to rotate counter-clockwise so the first bending lobe 46 disengages the skirt portion 96. As a result, the skirt portion 96 is allowed to spring slightly outward from the anvil 20 into its final bent orientation, such as a 90 degree bend relative to the body portion 94, for example. It will be appreciated that the bending lobes 46, 48 of the rocker 24 and the anvil beak 98 may be formed with any suitable angles to achieve various alternative final bend configurations in the workpiece 92. As the rocker 24 reaches its neutral position, the second shoulder surface 60 abuts the first planar face 83*a* of the plunger 70 to prevent the rocker 24 from rotating beyond the neutral position, as described above.

Referring to FIG. 7, a rotary bender 110 according to another exemplary embodiment of the invention is shown, for which similar reference numerals refer to similar features of the rotary bender 10. The rotary bender 110 is similar in construction and function to rotary bender 10, except as otherwise described below.

The lubricous layer provided between the bearing surface 44 and the rocker 24 is defined by a plurality of self-lubricating plugs 112, which may be formed of graphite, for example. The self-lubricating plugs 112 are received within ports 114 that extend through the bearing surface 44 and into the saddle 22. The ports 114 may be arranged in rows formed along each of the first and second tangential contact lines X1, X2 (see FIGS. 5A and 5B). Additionally, the bearing surface 44 may be coated with or otherwise formed of a bronze alloy, such as aluminum bronze, to enhance the lubricous effect.

A return element 116 of the rotary bender 110 includes a plunger 118 and a plunger passageway 120 having circular cross-sections. The plunger 118 includes a bore that receives and retains a portion of the return spring 72, similar to channel 76 of plunger 70. Advantageously, the circular cross-sectional shapes of the plunger 118 and passageway 120 provide for increased ease of manufacturing and decreased material use relative to similar features having noncircular cross-sectional shapes. The circular cross-sectional shape of the plunger 118 may result in tangential contact between a side surface 122 of the plunger 118 and the second shoulder surface 60 of the rocker 24 when the rocker 24 is in the neutral position.

While the present invention has been illustrated by the description of specific embodiments thereof, and while the embodiments have been described in detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described.

Accordingly, departures may be made from such details without departing from the scope of the general inventive concept.

What is claimed is:

1. A rotary bending device for bending a workpiece, comprising:

a saddle including a longitudinally extending cavity that includes a bearing surface;

a rocker received within the longitudinally extending cavity and rotatable relative to the saddle between a neutral position and a bending position for bending the workpiece, the rocker including an outer surface that contacts the bearing surface of the saddle;

a first alignment element provided on the rocker;

a second alignment element positioned to engage the first alignment element to limit axial movement of the rocker relative to the saddle during rotation of the rocker between the neutral position and the bending position; and a gib coupled to the saddle and positioned to contact the outer surface of the rocker for retaining the rocker within the longitudinally extending cavity, wherein the second alignment element is provided on the gib.

2. The rotary bending device of claim 1, wherein the first alignment element includes one of a slot or a rib, and the second alignment element includes the other of a slot or a rib.

3. The rotary bending device of claim 1, wherein the first alignment element includes a slot formed in the rocker and the second alignment element includes a rib projecting outwardly from the gib and is sized to be received within the slot.

4. The rotary bending device of claim 3, where the slot extends circumferentially about a longitudinal axis of the rocker.

5. The rotary bending device of claim 1, wherein the rocker includes a longitudinally extending shoulder, and the device further comprises:

at least one return element positioned to contact the longitudinally extending shoulder of the rocker for biasing the rocker toward the neutral position.

6. The rotary bending device of claim 5, wherein the longitudinally extending shoulder extends contiguously for a full length of the rocker.

7. A rotary bending device for bending a workpiece, comprising:

a saddle including a longitudinally extending cavity having a bearing surface;

a rocker received within the longitudinally extending cavity and rotatable relative to the saddle between a neutral position and a bending position for bending the workpiece, and wherein the rocker tangentially contacts the bearing surface at no more than two lines of tangential contact during rotation of the rocker between the neutral position and the bending position.

8. The rotary bending device of claim 7, wherein the longitudinally extending cavity is formed with a noncircular cross-sectional shape.

9. The rotary bending device of claim 7, wherein a cross-sectional shape of the longitudinally extending cavity is defined at least in part by first, second, and third arcs.

10. The rotary bending device of claim 7, further comprising:

a lubricous layer provided between the bearing surface of the saddle and an outer surface of the rocker.

11. The rotary bending device of claim 10, wherein the lubricous layer includes a dry film lubricant.

12. The rotary bending device of claim 10, wherein the saddle includes a plurality of ports formed in the bearing surface, and the lubricous layer includes a bronze alloy film formed on the bearing surface and a plurality of self-lubricating plugs received within the ports.

13. The rotary bending device of claim 7, wherein the rocker includes a longitudinally extending shoulder, and the device further comprises:

at least one return element positioned to contact the longitudinally extending shoulder of the rocker for biasing the rocker toward the neutral position.

14. The rotary bending device of claim 13, wherein the longitudinally extending shoulder is defined by a longitudinally extending notch formed in the rocker.

15. The rotary bending device of claim 13, wherein the longitudinally extending shoulder includes a first shoulder surface adapted to contact an end of the at least one return element for biasing the rocker toward the neutral position, and a second shoulder surface adapted to contact a side of the at least one return element for preventing rotation of the rocker beyond the neutral position in a direction from the bending position.

16. The rotary bending device of claim 15, wherein the first and second shoulder surfaces are planar.

17. The rotary bending device of claim 13, wherein the longitudinally extending shoulder extends contiguously for a full length of the rocker.

18. The rotary bending device of claim 13, wherein the at least one return element includes a plunger and a spring.

19. The rotary bending device of claim 18, wherein the plunger is formed with a noncircular cross-sectional shape.

20. The rotary bending device of claim 18, wherein the longitudinally extending shoulder includes at least one planar surface and the plunger includes at least one planar side surface adapted to contact the at least one planar surface of the plunger for preventing rotation of the rocker beyond the neutral position in a direction from the bending position.

* * * * *